United States Patent [19]

Trishevsky et al.

[11] 4,292,830

[45] Oct. 6, 1981

[54] MILL FOR MAKING TRANSVERSE DEFORMATIONS ON SHEET METAL

[76] Inventors: Igor S. Trishevsky, ulitsa 23 Avgusta, 47, kv. 42; Oleg I. Trishevsky, ulitsa Dzerzhinskogo, 34, kv. 7; Vladimir N. Bosy, ulitsa Oktyabrskoi Revoljutsii, 63, kv. 5; Rustem J. Deberdeev, ulitsa Bairona, 148, kv. 52, all of Kharkov; Leonid V. Radjukevich, ulitsa Tukhachevskogo, 22, korpus 2, kv. 253, Moscow; Vyacheslav I. Anisimov, ulitsa Metallurgov, 11, kv. 16, Magnitogorsk; Jury A. Plesnetsov, ulitsa Darvina, 20, kv. 6; Valery V. Chukhno, ulitsa Darvina, 16, kv. 5, both of Kharkov, all of U.S.S.R.

[21] Appl. No.: 98,967

[22] Filed: Nov. 30, 1979

[51] Int. Cl.[3] ..... B21B 45/00; B21D 37/16

[52] U.S. Cl. ..... 72/197; 72/342

[58] Field of Search ..... 72/128, 187, 197, 202, 72/342

[56] References Cited

U.S. PATENT DOCUMENTS

| | | | |
|---|---|---|---|
| 2,277,725 | 3/1942 | Smith et al. | 72/197 X |
| 3,509,753 | 5/1970 | Orth | 72/177 |

FOREIGN PATENT DOCUMENTS

| | | | |
|---|---|---|---|
| 1040420 | 8/1966 | United Kingdom | 72/202 |
| 582870 | 12/1977 | U.S.S.R. | 72/342 |

*Primary Examiner*—James G. Smith

*Attorney, Agent, or Firm*—Lackenbach, Lilling & Siegel

[57] ABSTRACT

A mill comprises at least one rolling stand with rolls having congruent lengthwise arranged forming elements, a drive stand and apparatus for locally heating a sheet metal at its portions to be transversely deformed or corrugated. The apparatus for locally heating the sheet metal includes inductors and a cam mechanism adapted to move said inductors up to and down from the sheet metal. The distributing shaft of the cam mechanism is connected through a transfer mechanism with one of the rolls of the rolling stand. The gear ratio of the transfer mechanism is equal to the number of the forming elements of one of the rolls of the rolling stand. The mill is simple in construction and easy to re-adjust when producing sheet panels with another spacing between the deformed portions or corrugations.

4 Claims, 20 Drawing Figures

MILL FOR MAKING TRANSVERSE DEFORMATIONS ON SHEET METAL

BACKGROUND OF THE INVENTION

1. Field of the Invention

The present invention relates to metal shaping, and more particularly to a mill for making transverse deformations or corrugations on a sheet metal.

The term "transverse deformation" as used herein refers to making transversely extending deformed portions or corrugations on uninterruptedly moved sheet metal. The deformed portions are shaped as parallel corrugations surrounded by flat (undeformed) portions which separate the former from each other and from the metal strip periphery.

The mill of the present invention is preferably intended to be used in metallurgy or in a machine-building industry for manufacturing sheet metal panels reinforced with corrugations. Such sheet metal panels are widely used as building structural units or metalcoating for freight containers and the like.

2. Description of the Prior Art

Known in the art is a mill for cold making transverse deformations on a sheet metal (U.S. Pat. No. 3,509,753) comprising a rolling stand with forming rolls having congruent lengthwise arranged forming elements, and a drive stand. Mills of the above type are commonly used for manufacturing thin-gauge sheet metal panels with shallow corrugations deepened thereinto for no more than two or three times the material thickness.

Nowadays, transversely corrugated sheet metal panels find ever increasing application. The field of application for such panels has extended as well, which consequently advances a number of additional requirements. Thus, a requirement has arisen for improving the supporting power of such panels. To meet this requirement, the manufacturers have to use sheet metals either of a higher strength, i.e. of low plasticity, or high plasticity sheet metals of a heavier gauge. In both cases, the supporting power of a sheet metal panel may additionally be improved through an increase of the corrugation depths.

Yet it is well known that high-strength steels are difficult to shape in a cold state because of their poor plasticity. The cold roll shaping of such steels is, therefore, impracticable because they are liable to shattering and cracking in portions being corrugated.

The use of sheet metal of a heavier gauge calls for a considerable increase in the power consumption and, consequently, an increase in the drive power of the rolls of the rolling stand as well as an increase in the overall dimensions of the rolling stand up to a technologically unreal size.

In addition, an increase in the corrugation depths leads to a cross-sectional distortion (twisting) of flat portions in shaped sheet metal panels. This results from sharply differing stresses between portions being corrugated and portions being kept flat.

Also known is a mill for making transversely extending deformations on a sheet metal (USSR Inventor's Certificate No. 513,094) which is intended for manufacturing sheet panels of a high-strength or thickgauge plastic sheet metal, which panels have deep transverse corrugations exceeding in height three times the material thickness. The mill comprises at least one rolling stand with rolls having congruent lengthwise arranged forming elements, at least one drive stand, and means for locally heating the sheet metal at its portions to be transversely corrugated. The locally heating means includes inductors with a cooling system and a mechanism adapted to move the inductors towards the sheet metal and therefrom. The inductor-moving mechanism is made in the form of a continuous belt adapted to transport the inductors positioned thereon at intervals equal to the spacings between the portions to be transversely deformed on the sheet metal. The continuous belt drive roller is kinematically (operatively) connected with one of the rolls of the rolling stand. The inductor cooling system includes a drum having two chambers one of which communicates with a coolant source and the other communicates with a coolant discharge means. The drum chambers also communicate with hoses connected to the inductors.

When the sheet metal is fed towards the forming rolls of the rolling stand, each of the inductors on the continuous belt at the side thereof facing the sheet metal accompanies an appropriate portion of the sheet metal and heats the same up to a pre-assigned temperature. As the heated metal portion is fed into the clearance between the rolls, the appropriate inductor is transferred to the other side of the continuous belt. As the inductor is being transferred, the drum is turned to prevent the hoses connected thereto from being snarled or twisted.

Despite the fact that the mill described above is intended to make transverse deformations on a high-strength and thick-gauge plate metal, the employment thereof involves some difficulties. These difficulties consist in that in re-adjusting the mill to the metal panels with different spacings between adjacent corrugations, it is required to remove therefrom or to add thereto some inductors, or to change the length of the continuous belt by removing therefrom or adding thereto some links. Besides, since the inductors are mounted on a flexible element, i.e. a continuous belt, it is difficult to maintain a constant optimum clearance between the sheet metal and the inductors when the metal is being heated. This involves a loss of power, a low heating effect and, finally a low quality of the products manufactured by the mill.

To enable the continuous belt to move in synchronism with the drum, it is necessary to use complicated additional means.

One of the disadvantages of the known mill is that, when it is in operation, only half of the heating inductors are operated. That is, when one part of the inductors is moved in synchronism with and facing the sheet metal to provide local heating thereof, the other part is moved in the opposite direction (being on the other side of the continuous belt) and thus takes no part in the heating process. Therefore, in addition to an ineffective use of practically half the inductors, the means of the above type for locally heating the sheet metal, in case the spacings between the adjacent sections are to be deformed are great, leads to a considerable increase in the spacing between rolling stands and eventually to an increase in the total mill length.

The object of the invention is to overcome the above-mentioned disadvantages.

It is an object of the invention to provide a mill for making transverse deformations on a sheet metal which makes it possible to simplify the mill construction and reduce the mill length.

A further object of the invention is to provide a mill for making transverse deformations on the sheet metal, comprising such means for locally heating the sheet metal which enables the mill to be move effective and reliable.

Yet a further object of the invention is to provide a mill for making transverse deformations on the sheet metal, comprising such means for locally heating the sheet metal which makes it possible to decrease the mill power consumption.

SUMMARY OF THE INVENTION

These and other objects of the invention are attained in a mill for making transverse deformations on a sheet metal comprising at least one rolling stand with forming rolls having congruent lengthwise arranged forming elements, at least one drive stand with feed rolls, and means for locally heating the sheet metal at its portions to be transversely deformed. The heating means is provided with inductors and a mechanism adapted to move the inductors up to and down from the sheet metal, which means is kinematically connected through a transfer mechanism with one of the rolls of the rolling stand. The mechanism adapted to move the inductors is made in the form of a cam mechanism including a horizontal distributing shaft which is kinematically connected through the transfer mechanism with one of the rolls of the rolling stand and which is provided with cams interacting with pushers connected with the inductors, and the gear ratio of the transfer mechanism being equal to the number of the forming elements on one of the forming rolls in the rolling stand.

The mechanism adapted to move the inductors which is made in the form of a cam mechanism simplifies both the means for locally heating the sheet metal and the construction of the mill as a whole.

The mill of the present invention is simple in readjustment and it also makes it possible to select another spacing between the portions to be corrugated on the sheet metal panels, for which purpose it is only necessary to horizontally displace and then to fix the cams and the pushers with the inductors. An interaction of the pushers with the cams enables the inductors to be approached to the sheet metal and kept at a constant required interval therefrom. This makes it possible to obtain a required temperature level in the metal panels being heated and provide for optimum power consumption and an improved efficiency of the sheet metal deformation process.

Since each inductor is disposed and moved in one and the same plane, it is also possible to simplify the inductor cooling system and inductor feed system and thus reduce the overall length of the mill.

It is advantageous that the cams of the cam mechanism have the same outline and are disposed on the horizontal distributing shaft so that with the congruent forming elements of the rolls of the rolling stand being engaged in pairs, the axis of symmetry of each cam can be disposed vertically, and the maximum radius vector of each cam can be directed vertically upwards. This being the case, the inductors should be spaced from each other at a distance which is equal to that between the axial plane of the rolls of the rolling stand and the inductor disposed most closely thereto, and which distance amounts to a value equal to the ratio between the circumference of one of the rolls of the rolling stand and the number of the forming elements thereon. Such a constructional arrangement of the mill is preferable when deformations with small spacings therebetween are to be made on a sheet metal.

According to an alternative embodiment of the invention the cams should preferably be disposed on the horizontal distributing shaft so that with the congruent forming elements of the rolls of the rolling stand being engaged in pairs, the angle between the vertical and the axis of symmetry of each cam is $$\phi_i=(2\pi A_i n)/L$$

where $A_i$=selected distance from an inductor to the axial pane of the rolls of the rolling stand;

n=number of the forming elements on one of the rolls of the rolling stand; and

L=circumference of one of the rolls of the rolling stand.

Such an arrangement of the cams makes it possible to mount the pushers with the inductors along the mill in an arbitrary manner and, therefore, reduce the length of the latter.

It is also possible that the inductors be spaced from each other at a distance which is equal to that between the axial plane of the rolls of the rolling stand and the inductor disposed most closely to said plane and which distance amounts to $$S=L/(n\cdot k)$$

where

L=circumference of one of the rolls of the rolling stand:

n=number of the forming elements on one of the rolls of the rolling stand; and k=number of the inductors disposed within a section which is equal to the length of the arc between the adjacent forming elements of one of the rolls of the rolling stand.

This being the case, the cams are installed on the horizontal shaft so that with the congruent forming elements of the rolls of the rolling stand being engaged in pairs, the angle between the vertical and the axis of symmetry of the cam disposed most closely to the axial plane of the rolls of the rolling stand as well as the angle between the axis of symmetry of each following cam and each foregoing cam of the means for locally heating the sheet metal amounts to $$\alpha_i=2\pi/(n\cdot k)$$

where n=number of the forming elements on one of the rolls of the rolling stand; and k=number of the inductors (and the cams respective thereto) disposed within the section equal to the length of the arc between the adjacent forming elements of one of the rolls of the rolling stand.

Such an arrangement of the cams and the inductors along with a reduction of the mill length makes it possible to simplify the adjustment and the control of the means for locally heating the sheet metal.

BRIEF DESCRIPTION OF THE DRAWINGS

The invention will become more readily apparent from the following detailed description of the embodiments thereof, particularly when taken in conjunction with the accompanying drawings wherein the same elements are denoted by the same reference numerals and in which.

DESCRIPTION OF THE PREFERRED EMBODIMENTS

Figure 1:
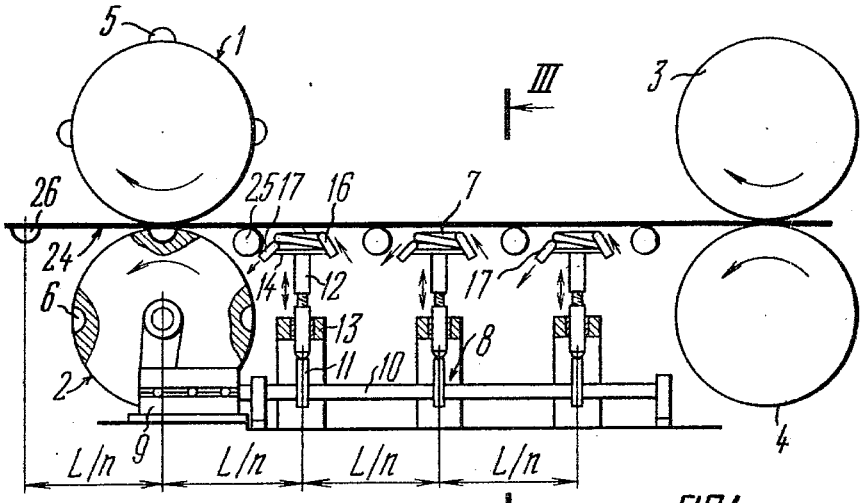
FIG. 1 is a schematic view of the mill for making transverse deformations on a sheet metal
Figure 2:
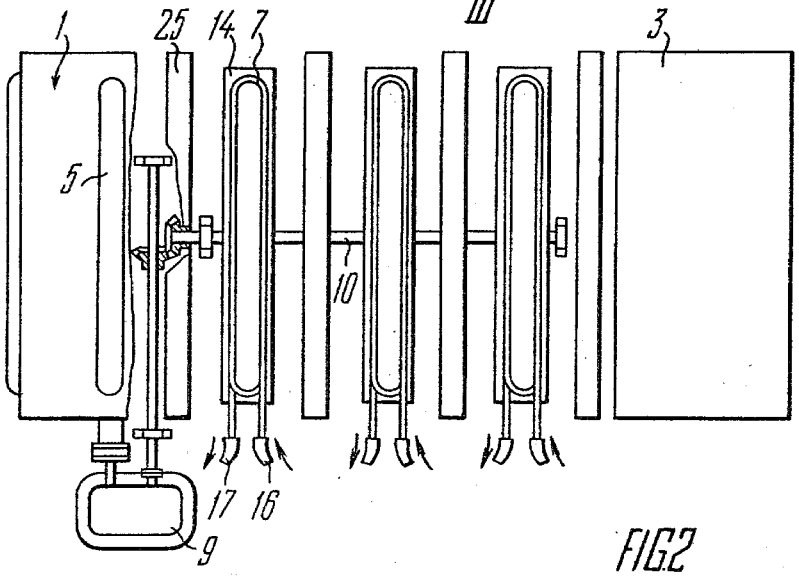
FIG. 2 is a top plan view of FIG. 1 with the sheet metal removed to show the means for locally heating the sheet metal.

The mill for making transverse deformations on a sheet metal comprises at least one rolling stand with rolls 1 and 2 (FIG. 1) and at least one drive stand with feed rolls 3 and 4. The rolls 1 and 2 of the rolling stand have congruent lengthwise disposed forming elements 5 and 6 (FIGS. 1 and 2). The mill also includes means for locally heating the sheet metal, which means comprises inductors 7 and a mechanism 8 adapted to move the inductors 7 up to and down from the sheet metal. The mechanism 8 is kinematically connected with the rolling stand roll 2 through a transfer mechanism 9.

According to the invention, the mechanism 8 adapted to move the inductors 7 is made in the form of a cam mechanism. The cam mechanism 8 (FIG. 1) comprises a horizontal distributing shaft 10 with cams 11 and pushers 12. The pushers 12 are disposed within the guide openings made in supports 13. On the upper ends of the pushers 12 there are mounted plates 14 of heat- and electric-insulating material. On the plates 14 there are mounted the inductors 7 (FIG. 2) made of a hollow conductor which, when viewed from the top, has the form of an elongated helix. The plates 14 are connected with the supports 13 by compression springs 15.

Figure 3:
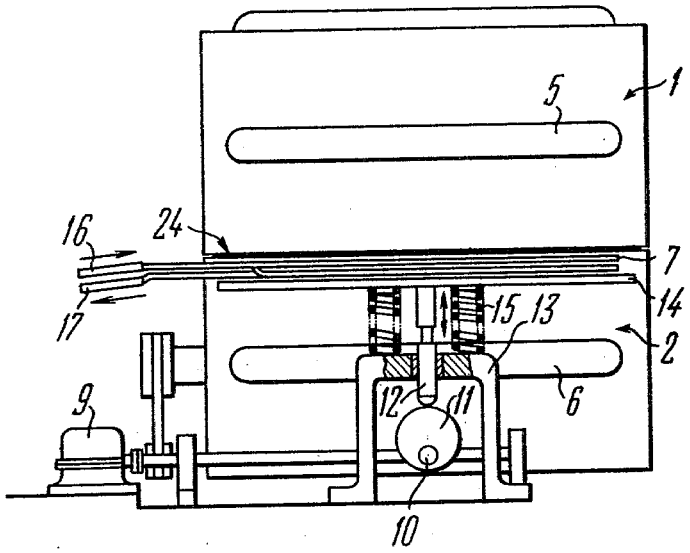
FIG. 3 is a cross-sectional view taken along the line III—III of FIG. 1, illustrating the transfer mechanism and an outline of the cams of the cam mechanism.

The cams 11 have the same outline and are disposed on the horizontal distributing shaft (FIGS. 1 and 3) so that with the congruent forming elements 5, 6 of the rolling stand rolls 1, 2 being engaged in pairs, the axis of symmetry of each cam is disposed vertically upwards. The inductors 7 or the cams 11 respective thereto are spaced from each other at a distance which is equal to that between the axial plane of the rolls 1, 2 of the rolling stand and the inductor 7 disposed most closely thereto and which distance amounts to a value equal to the ratio between the circumference of one of the rolls 1 or 2 of the rolling stand and the number of the forming elements 5, 6 thereon.

The horizontal distributing shaft 10 (FIG. 2) is kinematically connected with the rolling stand roll 2 through the transfer mechanism 9. The transfer mechanism 9 has a gear ratio equal to the number of the forming elements 5 on the rolling stand roll 1. This provides for turning the horizontal distributing shaft generally from 10° to 360° when the roll 1 is turned through 360°/n where n is a number of the forming elements 5.

The inductors 7 are provided with high frequency conductors (not shown) and hoses 16 and 17 for feeding and discharging a coolant respectively.

According to an alternative embodiment of the invention the cams 18, 19, 20 are disposed on the horizontal distributing shaft 10 so that with the congruent forming elements 5, 6 of the rolls 1, 2 of the rolling stand being engaged in pairs, the angle between the vertical and the axis of symmetry of each cam 18, 19 or 20 is $$\phi_i=(2\pi A_i \cdot n)/L$$

where $A_i$=selected distance from an inductor 7 to the axial plane of the rolls 1, 2 of the rolling stand;

n=number of the forming elements 5, 6 on one of the rolls of the rolling stand; and L=circumference of one of the rolls 1, 2 of the rolling stand.

According to another embodiment of the invention the inductors 7 or cams 21, 22, 23 respective thereto are spaced from each other at a distance which is equal to that between the axial plane of the rolls and the inductor 7 disposed most closely to said axial plane and which distance amounts to $$S=L/(n \cdot k)$$

where

L=circumference of one of the rolls 1, 2 of the rolling stand;

n=number of the forming elements 5, 6 on one of the rolls 1, 2 of the rolling stand; and k=number of the inductors 7 disposed within a section which is equal to the length of the arc between the adjacent forming elements 5 or 6 of one of the rolls 1 or 2 of the rolling stand.

This being the case, the cams 21, 22, 23 are installed on the horizontal shaft 10 so that, with the congruent forming elements 5, 6 of the rolls 1, 2 of the rolling stand being engaged in pairs, the angle between the vertical and the axis of symmetry of the cam 23 disposed most closely to the axial plane of the rolls of the rolling stand as well as the angle between the axis of symmetry of each following cam 22, 21 and the axis of symmetry of each foregoing cam 23, 22 of the means for locally heating the sheet metal amounts to $$\alpha_i = 2\pi/(n \cdot k)$$

where n = number of the forming elements 5, 6 on one of the rolls 1, 2 of the rolling stand; and k = number of the inductors 7 (or cams 23, 22, 21 respective thereto) disposed within the section equal to the length of the arc between the adjacent forming elements 5 or 6 of one of the rolls 1 or 2 of the rolling stand.

The above-described mill for making transverse deformations on a sheet metal operates as follows.

The feed rolls 3 and 4 of the drive stand (FIGS. 1 and 3) which are rotated at a speed not greater than that of the rolling stand rolls 1 and 2 feed a metal sheet 24 thereto by means of table rollers 25. The rotary motion of the rolling stand rolls 1 and 2 is transmitted through the transfer mechanism 9 to the horizontal distributing shaft 10. The inductors 7 are lifted and lowered with every turn of the horizontal distributing shaft 10. Since the axes of symmetry of the cams 11 are disposed in parallel to one another and the radius-vertors of all the cams 11 are oriented in the same direction, all the inductors 7 are brought close (i.e. occupy the operating position) to the sheet metal 24 and lowered in synchronism. Per one revolution the rolls 1 and 2 impart to the horizontal distributing shaft 10 the number of revolutions which is equal to the gear ratio of the transfer mechanism 9.

The sheet metal 24 is transported for a distance equal to the circumference of the roll 1 or 2 per one revolution of the latter. For this period, the inductors 7 are simultaneously brought to the portions of the sheet metal 24 to be heated and transversely corrugated and then removed therefrom n times (n = number of the forming elements 5 and 6 on the rolling stand roll 1 and 2, which number is equal to the gear ratio of the transfer mechanism 9).

Thus, when the inductors 7 are lifted, each of them heats the portions of the sheet metal 24 disposed in opposed relationship therewith up to a temperature $T_1$. During the next revolution of the horizontal distributing shaft 10, the sheet metal 24 is transported by the rolling stand rolls 1 and 2 for a distance equal to the ratio between the circumference of one of the rolls 1 or 2 and the number of the forming elements 5 or 6 thereon. The portions of the sheet metal 24 heated up to the temperature $T_1$ are again disposed in opposed relationship with the inductors 7 and heated up to a temperature $T_2$. As this takes place, the following sheet metal portion approaching by this time the first inductor in the direction of the metal travel is heated up to the temperature $T_1$.

Figure 16:
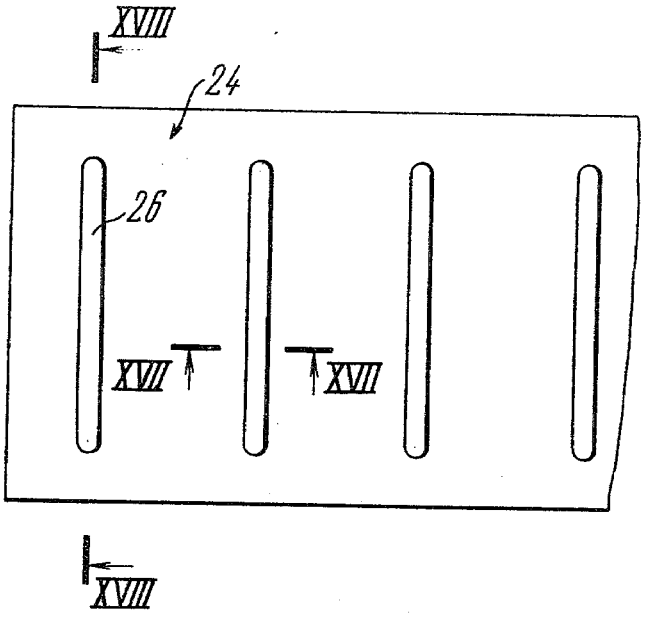
FIG. 16 is a fragmentary plan view of a product manufactured by means of making transverse deformations on the sheet metal.
Figure 17:
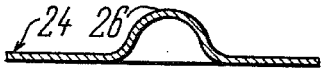
FIG. 17 is a cross-sectional view along the line XVII—XVII of FIG. 16.
Figure 18:
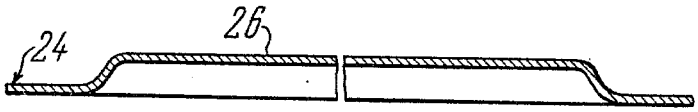
FIG. 18 is a cross-sectional view along the line XVIII—XVIII of FIG. 16.

Then the cycle is repeated, and one and the same portion of the sheet metal is heated therewith as many times as is the number of the inductors 7. The number of the inductors 7 is dictated by the conditions of heating the sheet metal 24 up to a temperature sufficient for a plastic deformation thereof. The finished product with transverse corrugations 26 formed therein by means of the rolls 1 and 2 (FIGS. 16, 17 and 18) is removed from the rolling stand.

Such a constructional arrangement of the apparatus is preferable when deformations with small spacings therebetween are to be made on a sheet metal.

According to another embodiment of the invention the mill operates as follows.

Figure 4:
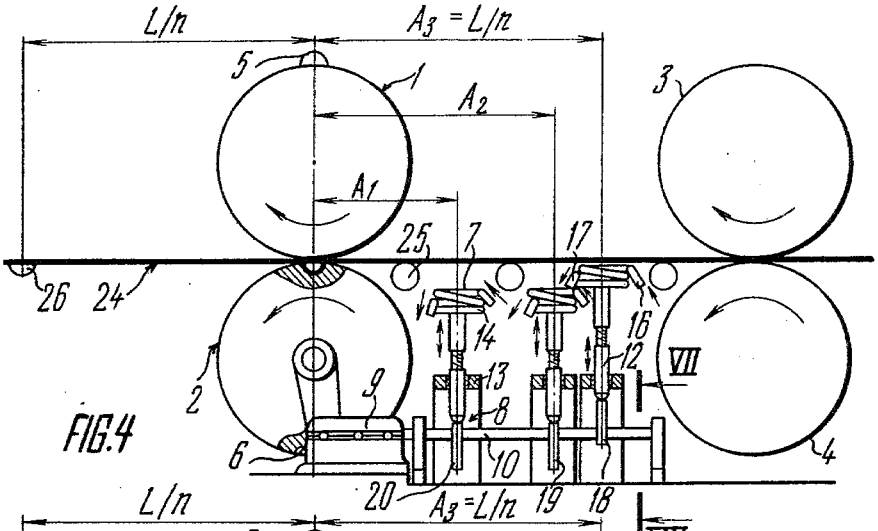
FIGS. 4, 5 and 6 schematically illustrate another modification of the mill, wherein the inductors of the means for locally heating the sheet metal are arbitrarily spaced from each other; for illustration purposes the rolls of the rolling stand are shown in one and the same position which corresponds to the moment of making a corrugation.
Figure 5:
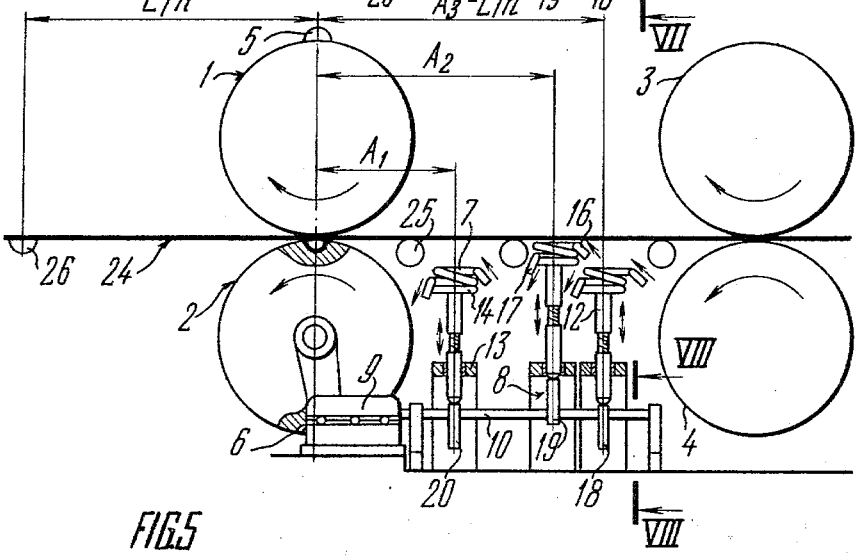
Figure 7:
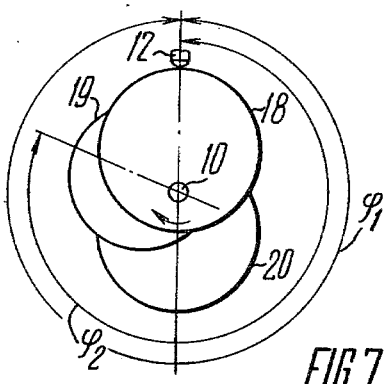
FIGS. 7, 8 and 9 are cross-sectional views along the lines VII—VII, VIII—VIII and IX—IX respectively of FIGS. 4, 5 and 6, illustrating the cams axis of symmetry displaced with respect to the vertical.
Figure 8:
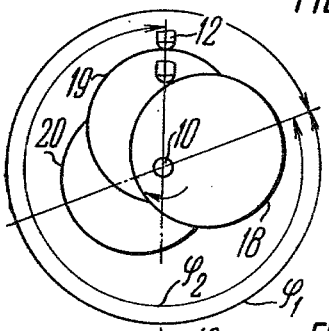

When a portion of the sheet metal 24 to be deformed approaches the first inductor 7 (FIG. 4), the latter, as a result of the interaction between the cam 18 and the pusher 12, is brought close to the sheet metal 24 and heats the same up to the temperature $T_1$. At the same time the inductors 7 disposed further in the direction of the metal travel remain removed from the metal sheet 24 and take no part in the heating thereof. This is due to the angular displacement of the axes of symmetry of the cams 19 and 20 (FIG. 7) respective to the above inductors 7. Thereafter, in interacting with a respective pusher 12 (FIG. 5) the cam 19 brings the next inductor 7 close to the portion of the sheet metal 24 previously heated up to the temperature $T_1$ and thus heating the same sheet metal portion up to the temperature $T_2$ is effected.

Figure 6:
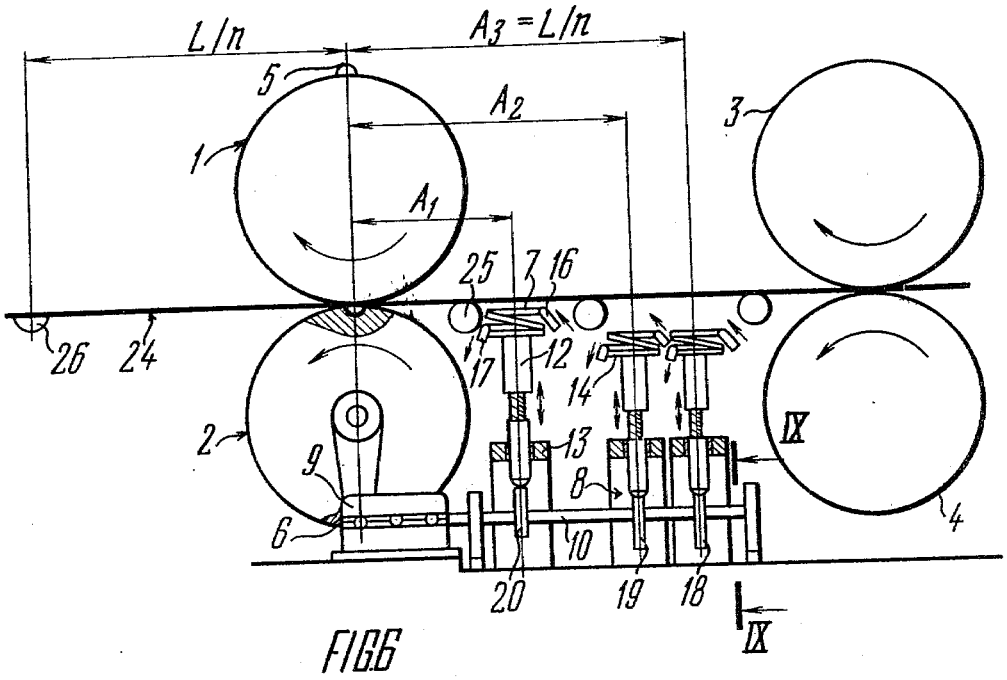
Figure 9:
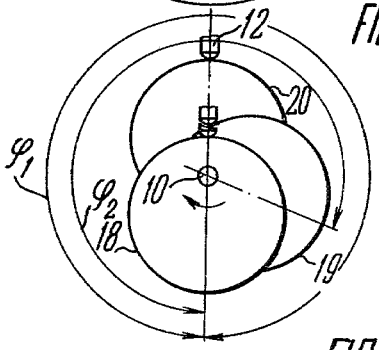
Figure 10:
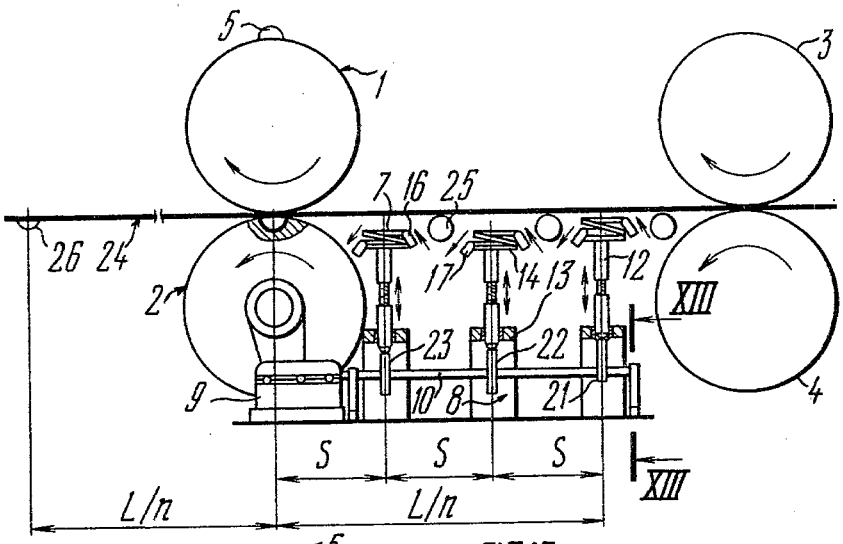
FIGS. 10, 11 and 12 schematically illustrate a further modification of the mill with all the inductors of the means for locally heating the sheet metal equally spaced; for illustration purposes the rolls of the rolling stand are shown in one and the same position which corresponds to the moment of making a corrugation.
Figure 11:
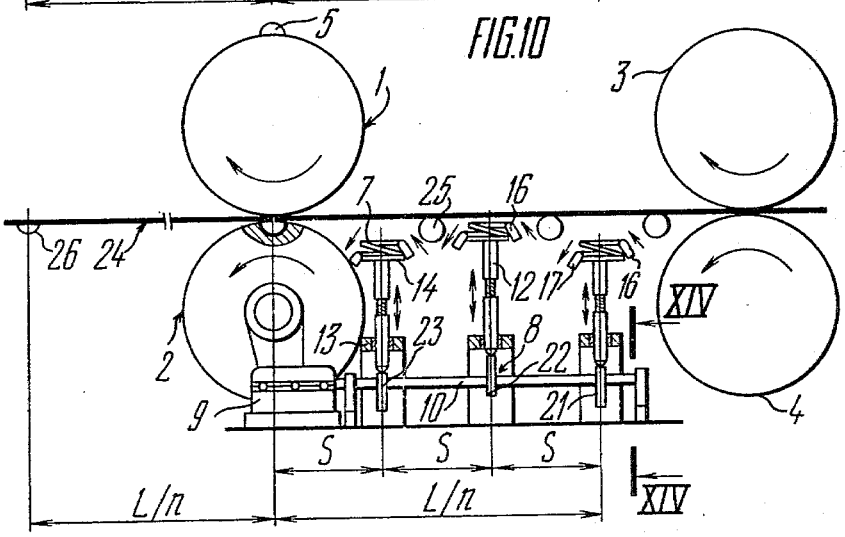
Figure 12:
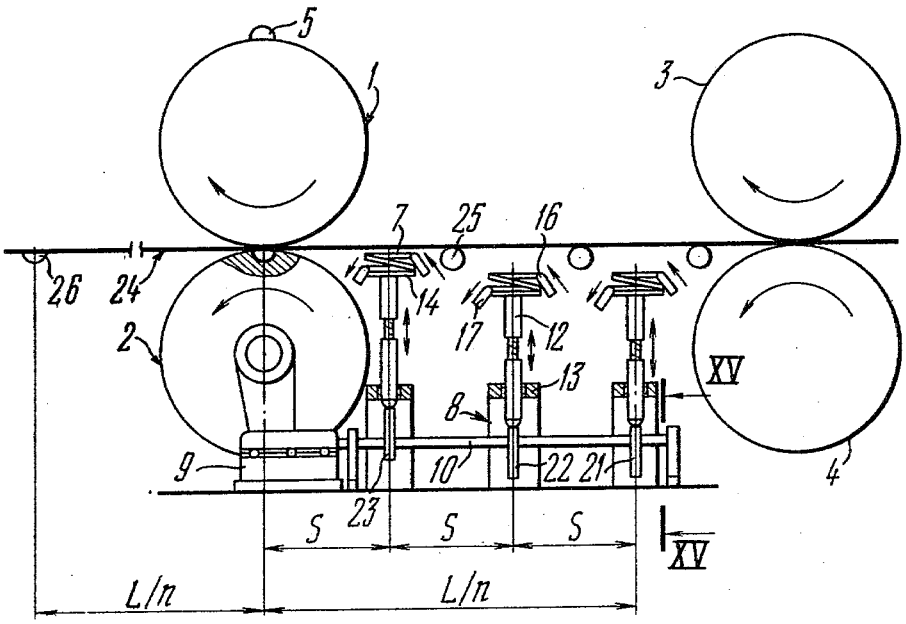
Figure 13:
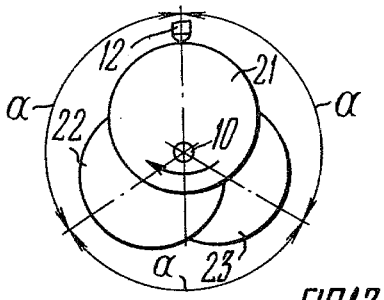
FIGS. 13, 14 and 15 are cross-sectional views along the lines XIII—XIII, XIV—XIV and XV—XV respectively of FIGS. 10, 11 and 12, schematically illustrating the displacement of the axis of symmetry of each cam with respect to one another as well as with respect to the vertical.
Figure 14:
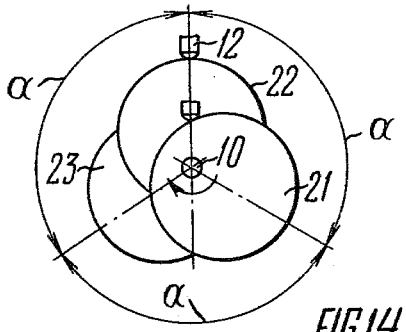
Figure 15:
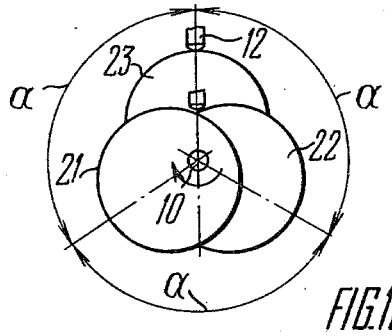

Heating the same portion of the sheet metal 24 is repeated with an attendance of the following (in the direction of the metal travel) inductors 7 (FIGS. 6, 9) and continued till the temperature necessary for making transverse corrugations is attained.

In this case the inductors 7 may be positioned at an arbitrary distance $A_1$ from the axial plane of the rolls 1 and 2. The rated value for determining the distance is represented by the angles $\phi_1$ of displacement of the axes of symmetry of the cams 18, 19 and 20 with respect to the vertical.

Such an arrangement of the cams is advisable when the spacings between the adjacent portions of the sheet metal to be deformed are so large that the heating of these portions, with the aid of the inductors brought close to the same portions, is insufficient. With this constructional arrangement of the apparatus, allowance is made for additional inductors employed within the section which is equal to the distance between adjacent corrugations to be made. The additional inductors are adapted to alternatedly heat the moving sheet metal portions to be deformed; and the distance between the inductors may be selected arbitrarily, depending on the heating conditions or the construction of the rolling stand. The inductors may be disposed in close proximity from the axial plane of the rolls, i.e. immediately ahead of the deformation zone. When large spacings between adjacent corrugations are to be made, the above constructional arrangement makes it possible to reduce the length of the rolling stand and thus the total length of the mill.

According to still another embodiment of the invention, the mill (FIGS. 10 to 15) operates essentially as described above, however, the inductors 7 are lifted and lowered at regular intervals towards a portion of the sheet metal 24 to be heated. This is provided for by the cams 21, 22 and 23 and hence the respective inductors 7 are equally spaced along the mill.

Such an arrangement of the cams and, consequently, the pushers with the inductors may be employed in case the corrugations are to be spaced at large distances from each other when there is no need of bringing the first inductor close to the axial plane of the rolls and also in case the construction of the mill permits the inductors and the pushers thereof to be equally spaced.

Figure 19:
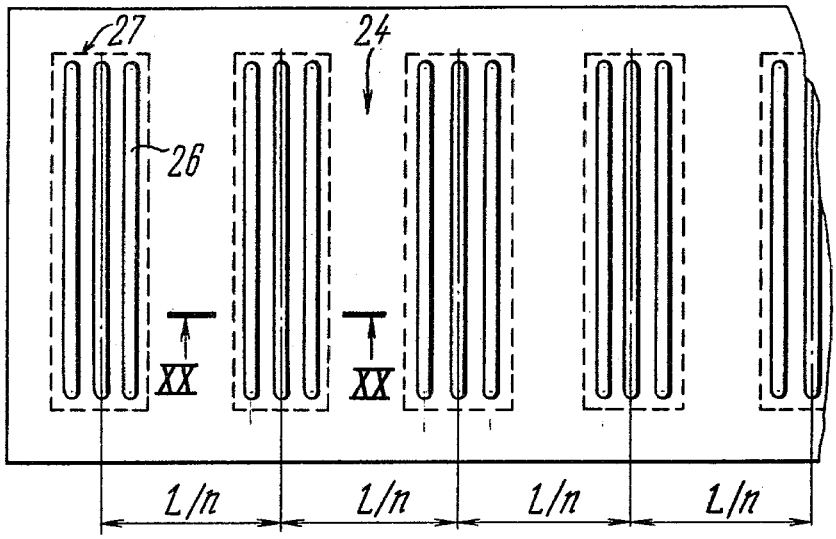
FIG. 19 is a fragmentary plan view of a product manufactured by means of making transverse deformations on the sheet metal through the use of the rolling stand rolls having forming elements which are closely spaced and form groups on the surface thereof.
Figure 20:
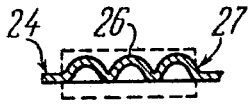
FIG. 20 is a cross-sectional view along the line XX—XX of FIG. 19.

The mill of the present invention is capable of effectively making sheet metal products (FIGS. 19 and 20)

having transversely extending corrugations 26 arranged in group 27. In this case, the term "the number of forming elements (n)" referes to the number of groups 27 of the forming elements on any of the rolling stand rolls. The inductors are to be disposed in the direction of the sheet metal travel and oriented to the lengthwise axes of symmetry of groups 26 of the corrugations 27, rather than to individual corrugations. The gear ratio of the transfer mechanism 9 is equal to the number of groups of the forming elements on any roll of the rolling stand.

In all of the above cases, the number of the inductors is selected in accordance with the temperature of heating a sheet metal portion to be deformed, the rate of shaping, the thickness of the sheet blank and the material it is made of. If desired, the number of the inductors can be increased not only within the section which is equal to that between the adjacent portions to be deformed but also within any other section which may exceed the distance between the adjacent portions to be deformed. This makes it possible to heat the sheet metal portions being deformed to a required temperature.

While particular embodiments of the invention have been shown and described, various modifications thereof will be apparent to those skilled in the art. Thus, it is not intended that the invention is to be limited to the disclosed embodiments or to the details thereof and departures may obviously be made therefrom so long as same is within the scope of the invention as defined in the accompanying claims.

What is claimed is:

1. A mill for making transverse deformations on a sheet metal, comprising:

at least one rolling stand having rolls with congruent lengthwise arranged forming elements;

at least one drive stand with feed rolls;

means for locally heating the sheet metal at its portions to be transversely deformed, which means includes inductors and a cam mechanism which is adapted to move the inductors up to and down from the sheet metal and is provided with a horizontal distributing shaft having cams and pushers connected to said inductors; and a transfer mechanism operatively connecting said horizontal distributing shaft of the cam mechanism with one of the rolls of said rolling stand, and the gear ratio of the transfer mechanism being equal to the number of the forming elements on one of the rolls of said rolling stand.

2. A mill as claimed in claim 1, wherein the cams of the cam mechanism of said means for locally heating the sheet metal have the same outline and are disposed so that with the congruent forming elements of the rolls of the rolling stand being engaged in pairs, the axis of symmetry of each cam of the cam mechanism of the means for locally heating the sheet metal is disposed vertically so that the maximum radius vector of each cam is directed vertically upwards, and the inductors of said means for locally heating the sheet metal are spaced from each other at a distance equal to that between the axial plane of the rolls of said rolling stand and the inductor disposed most closely thereto, this distance amounting to a value which is equal to the ratio between the circumference of one of the rolls of said rolling stand and the number of the forming elements thereon.

3. A mill as claimed in claim 1, wherein the cams are disposed on the horizontal distributing shaft of the cam mechanism of said means for locally heating the sheet metal so that with the congruent forming elements of the rolls of said rolling stand being engaged in pairs, the angle between the vertical and the axis of symmetry of each cam of the cam mechanism of said means for locally heating the sheet metal is $$\phi_i=(2\pi A_i \cdot n)/L$$

where $A_i$=selected distance from an inductor of said means for locally heating the sheet metal to the axial plane of the rolls of said rolling stand;

n=number of the forming elements on one of the rolls of said rolling stand; and

L=circumference of one of the rolls of said rolling stand.

4. A mill as claimed in claim 1, wherein the inductors of said means for locally heating the sheet metal are spaced from each other at a distance which is equal to that between the axial plane of the rolls of said rolling stand and the inductor disposed most closely thereto and which distance amounts to $$S=L/(n \cdot k)$$

where

L=circumference of one of the rolls of said rolling stand;

n=number of the forming elements on one of the rolls of said rolling stand; and k=number of the inductors of said means for locally heating the sheet metal which are disposed within the section equal to the length of the arc between the adjacent congruent forming elements of one of the rolls of the rolling stand;

the cams of the cam mechanism of said means for locally heating the sheet metal being disposed so that with the congruent forming elements of the rolls of said rolling stand being engaged in pairs, the angle between the vertical and the axis of symmetry of the cam disposed most closely to the axial plane of the rolls of said rolling stand as well as the angle between the axis of symmetry of each following cam and the axis of symmetry of each foregoing cam of the cam mechanism of said means for locally heating the sheet metal amounts to $$\alpha_i=\pi 2/(n \cdot k)$$

where n=number of the forming elements on one of the rolls of said rolling stand; and k=number of the inductors of said means for locally heating the sheet metal which are disposed within the section equal to the length of the arc between adjacent congruent forming elements of one of the rolls of said rolling stand.

* * * * *